US009631374B2

(12) United States Patent
Tang

(10) Patent No.: US 9,631,374 B2
(45) **Date of Patent: *Apr. 25, 2017**

(54) NARROW LINED MODULAR FLOORING ASSEMBLIES

(71) Applicant: CoMc, LLC, Omaha, NE (US)

(72) Inventor: Yu Lin Tang, Gu Bei (CN)

(73) Assignee: CoMc, LLC, Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/235,581

(22) Filed: Aug. 12, 2016

(65) Prior Publication Data

US 2016/0348376 A1 Dec. 1, 2016

Related U.S. Application Data

(63) Continuation of application No. 14/953,825, filed on Nov. 30, 2015, now Pat. No. 9,416,548, which is a continuation of application No. 14/694,392, filed on Apr. 23, 2015, now Pat. No. 9,200,461, which is a continuation of application No. 14/306,835, filed on (Continued)

(51) Int. Cl.

| | |
|---|---|
| ***E04F 15/02*** | (2006.01) |
| ***E04F 15/08*** | (2006.01) |
| ***E04F 15/04*** | (2006.01) |
| ***E04F 15/022*** | (2006.01) |
| ***E04F 15/18*** | (2006.01) |

(Continued)

(52) U.S. Cl.

CPC ..... *E04F 15/02044* (2013.01); *E04F 15/022* (2013.01); *E04F 15/02005* (2013.01); *E04F 15/02011* (2013.01); *E04F 15/0215* (2013.01); *E04F 15/02038* (2013.01); *E04F 15/02194* (2013.01); *E04F 15/02458* (2013.01); *E04F 15/04* (2013.01); *E04F 15/041* (2013.01); *E04F 15/08* (2013.01); *E04F 15/082* (2013.01); *E04F 15/087* (2013.01); *E04F 15/182* (2013.01); *E04F 15/187* (2013.01); *E04F 15/225* (2013.01); *E04F 2015/02105* (2013.01); *E04F 2201/0115* (2013.01); *E04F 2201/022* (2013.01); *E04F 2201/095* (2013.01)

(58) Field of Classification Search

CPC ..... E04F 15/02; E04F 15/02005; E04F 15/02038; E04F 15/022; E04F 2201/0115; E04F 2201/022

See application file for complete search history.

(56) References Cited

U.S. PATENT DOCUMENTS 6,694,691 B2 * 2/2004 Ku ..... E01O 5/223 52/403.1

7,197,855 B2 4/2007 Della Pepa (Continued)

FOREIGN PATENT DOCUMENTS

WO 2009/055852 A1 5/2009

*Primary Examiner* — Ryan Kwiecinski

(74) *Attorney, Agent, or Firm* — Edwin A. Sisson, Attorney at Law, LLC; Jeffrey J. Banyas

(57) ABSTRACT

This specification describes a tray substrate for tile flooring that can be used in narrow grout line modular floating tile assemblies. The tray is preferably made of plastic and has vertical tray edges around the top of the tray substrate with upward and downward tabs protruding from the sides of the tray substrate wherein some of the tabs are at least partially recessed under the surface of the tray.

8 Claims, 9 Drawing Sheets

Related U.S. Application Data

Jun. 17, 2014, now Pat. No. 9,038,345, which is a continuation of application No. 13/376,753, filed on Dec. 7, 2011, now Pat. No. 8,782,990, which is a continuation-in-part of application No. 12/791,897, filed as application No. PCT/US2010/038049 on Jun. 9, 2010, now Pat. No. 8,782,989.

(60) Provisional application No. 61/186,283, filed on Jun. 11, 2009.

(51) Int. Cl.
*E04F 15/024* (2006.01)
*E04F 15/22* (2006.01)

(56) References Cited

U.S. PATENT DOCUMENTS 7,543,417 B2 * 6/2009 McIntosh ..... E04F 15/02044 52/177
7,779,602 B2 * 8/2010 Collison ..... E04F 15/043 52/177
7,900,416 B1 * 3/2011 Yokubison ..... E04F 15/10 52/177
8,186,116 B2 * 5/2012 Anderson ..... E01C 5/001 52/181
2003/0101681 A1 6/2003 Tychsen
2003/0136070 A1 * 7/2003 Ku ..... E01O 5/223 52/403.1
2004/0139679 A1 * 7/2004 Della Pepa ..... E01O 5/001 52/578
2006/0230701 A1 * 10/2006 Pepa ..... B29C 70/78 52/592.1
2007/0094969 A1 * 5/2007 McIntosh ..... E04F 15/02044 52/386
2008/0078135 A1 * 4/2008 McIntosh ..... E04F 15/02016 52/396.1
2008/0092473 A1 * 4/2008 Heyns ..... E04F 13/08 52/385
2008/0313987 A1 * 12/2008 Ibanez ..... E04F 15/02016 52/384
2009/0266019 A1 * 10/2009 McIntosh ..... E04F 15/02044 52/415
2010/0257801 A1 * 10/2010 Anderson ..... E01O 5/001 52/391
2011/0113713 A1 * 5/2011 Lui ..... E04F 13/14 52/391

* cited by examiner

NARROW LINED MODULAR FLOORING ASSEMBLIES

PRIORITY AND CROSS REFERENCES

This application claims priority from U.S. Provisional Patent Application No. 61/186,283 filed 11 Jun. 2009; PCT/US2010/038049 (US) filed 9 Jun. 2010; a continuation in part application of U.S. patent application Ser. No. 12/791,897 filed 2 Jun. 2010 which issued on 22 Jul. 2014 as U.S. Pat. No. 8,782,989; a continuation of U.S. patent application Ser. No. 13/376,753 filed 7 Dec. 2011 which issued on 22 Jul. 2014 as U.S. Pat. No. 8,782,990, a continuation of U.S. patent application Ser. No. 14/306,835 filed 17 Jun. 2014 which issued on 26 May 2015 as U.S. Pat. No. 9,038,345, and a continuation of U.S. patent application Ser. No. 14/694,392 filed 23 Apr. 2015 which issued on 1 Dec. 2015 as U.S. Pat. No. 9,200,461, and a continuation of U.S. patent application Ser. No. 14/953,825 filed 30 Nov. 2015 the teachings of each of which are incorporated in their entirety.

FIELD OF INVENTION

The present invention relates to a modular flooring assembly including a flooring component adhered to a tray substrate.

BACKGROUND

United States Patent Publication 2007009469 teaches the use of a tray substrate and a flooring component to create a floating tile structure. The trays interlock with each other as demonstrated in FIG. 17 of that specification. U.S. Pat. No. 7,197,855 teaches the use of a tray substrate with a flooring component attached that is interlocked as well.

Both of these systems provide for interlocks between the tray that completely extend from the side of the tray. Generally these interlocks set the size of the gap between the trays. One can make the gaps narrow by reducing the size of the locking mechanisms. However, reducing the size of the locking mechanism reduces the strength of the lock and also leads to breakage of the interlocks during installation due to their small size.

There exists therefore a need for a tray substrate system which can provide strength and size of the interlocking mechanism yet maintain a small gap between the tiles attached to the interlocked tray substrate.

SUMMARY

The present invention relates to a modular flooring assembly including an optional flooring component such as a tile adhered to a tray substrate. The modular flooring assembly may be interconnected with additional modular flooring assemblies to form a modular floor suitable for most flooring applications. The flooring component may comprise tile or wood or other materials commonly used in flooring applications. Conventional fill-in grout or a snap-in grout may be used with the modular flooring assemblies.

Disclosed in this application is a component of a flooring system comprising a tray substrate comprising a tray substrate surface which is an upward facing horizontal surface having a tray substrate surface perimeter, a tray substrate bottom with a padding attached to the tray substrate bottom, a plurality of tray substrate vertical tray edges which protrude upward and extend along the tray substrate surface perimeter, a plurality of tray substrate edges defining an outside perimeter of the tray substrate, the tray substrate edges having a plurality of upward tabs comprising a surface and a valley and a plurality of downward tabs comprising a surface and a lip, wherein at least a portion of the downward tab is recessed under the upward facing horizontal tray surface. It is further disclosed that the tray substrate may have a flooring component adhered to the tray substrate surface with an adhesive.

It is further disclosed that the flooring component may be selected from the group consisting of tile, stone, marble, wood, ceramic tile, porcelain tile, and granite. It is also further disclosed that the flooring component may be smaller than the tray substrate surface. It is also further disclosed that the tray substrate vertical tray edges may run the entire perimeter of the tray substrate surface.

DETAILED DESCRIPTION OF THE PREFERRED EMBODIMENTS

Figure 1:
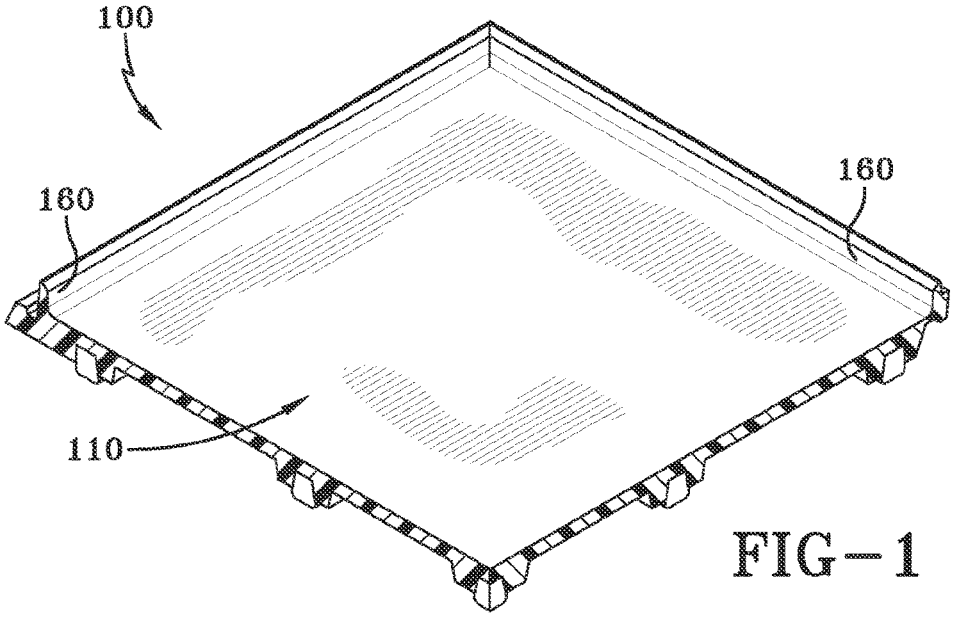
FIG. 1 is a perspective view of the tray substrate.

The present invention relates to a modular flooring assembly including a flooring component adhered to a tray substrate. The modular flooring assembly may be interconnected with additional modular flooring assemblies to form a modular floor suitable for most flooring applications. The flooring component may comprise tile or wood or other materials commonly used in flooring applications. The tray substrate comprises tabs, which provide for the tray substrates to interlock with tabs from an adjacent tray substrate. The fully assembled modular floor provides the appearance of a conventional floor. Fill-in grout or a snap-in grout may be used with the modular flooring assemblies.

The modular floor may be quickly disassembled and does not damage the sub floor, as the modular floor is not typically attached to the sub floor by adhesives, grout compounds, or other fastening means. Further, the modular floor may be installed over an existing sub floor without the installation of a concrete backer board, which is commonly used in ceramic tile installation.

The tray substrate holds the flooring component on its tray surface. The tray surface is an upward facing horizontal surface with vertical tray edges which protrude upward around the perimeter of the tray surface and outline the perimeter of the tray surface.

The tray surface may be generally flat, or may contain a pattern designed to enhance adhesive performance between the tray surface and the flooring component. The tray surface pattern may be designed to complement the bottom of the flooring component; for example, tiles may have different mold patterns on their bottom depending upon the manufacturer's design. The tray surface may also be solid, or may have holes therein. The holes may be added in appropriate locations to aid in moisture evaporation without compromising adhesive performance.

The vertical tray edges are designed to ensure substantially exact, or exact, alignment of the flooring component with the tray surface, and help provide a barrier to ensure adhesive can be applied over the entire bottom of the flooring component without the adhesive being pushed or flowing into the tab areas. If adhesive is allowed to enter the tab areas, their interlocking connection may be physically impaired by adhesive residue. The vertical tray edges do not have to run the entire perimeter of the tray substrate, but preferably should run the entire perimeter of the tray substrate. The inside of the vertical tray edges define an area smaller than the perimeter of the tray substrate. The flooring component is set inside the wall defined by the vertical tray edges and is adhered to the tray surface defined by the inside wall of the vertical tray edges.

By their vertical orientation, the tray edges positionally hold the flooring component and, in combination with the adhesive, reduce lateral movement. The tray edges may provide a further surface for the adhesive to adhere the side of the flooring component. The tray surface joins to the bottom of the flooring component via the adhesive and the tray edges join to the sides of the flooring component via the adhesive. The combination of the adhesive on the tray surface and the adhesive on the tray edges provide a secure hold for the flooring component. This insures that the flooring component is locked down to the tray substrate, and the flooring component does not slip or move.

The size of the tray substrate and the flooring component are strictly controlled to insure that the flooring component fits securely in the tray substrate. The flooring component should just fit onto the tray surface and rest snugly against the vertical edges. The flooring component should be slightly smaller than the tray surface defined by the vertical tray edges.

The present invention achieves significant advantages. A tray with four vertical tray edges, improves the structural rigidity of the tray. The four tray edges prevent adhesive from pushing into the interlocking tabs. In other systems, the adhesive can push into the tab area causing interference with the other tile. The four tray edges help align the flooring component to the tray, which improves assembly ease and quality. In other systems, the flooring surface is not constrained and therefore must be held in place until the adhesive has cured.

There are upward and downward facing tabs located on all sides of the tray substrate. The upward and downward orientation is based upon the tray bottom and the upward facing tray surface. The upward and downward tabs should alternate on each edge of the tray substrate, but they do not have to alternate. For example, there could be two downward tabs, one upward tab and two downward tabs. For most flooring applications, the use of 6, 8, or 10 tabs per edge, half of each orientation, provide satisfactory performance. In other embodiments, there may be fewer or additional tabs. The tabs do not necessarily have to alternate. In practice, it has been found that the number of tabs be in multiples of four.

The upward tab comprises a surface and a valley. The shape of the surface could be convex or flat or spiked. The downward tab includes a surface and a lip. The shape of the surface may be concave. As the downward tab is urged against the upward tab, the upward tab flexes as the lip slides over the convex surface and into the valley, such that the lip snaps into the valley and the concave surface presses over the convex surface. This provides a connection with sufficient rigidity to create a composite floor made of multiple modular flooring assemblies.

In order to provide the narrow grout line, or gap between the two interconnected tray substrates, the downward facing tab does not extend from the side of the tray substrate. Rather, the downward tab extends from a recessed area in the side of the tray substrate. The length of the recessed area as measured along the side of the tray substrate is at least slightly longer than the upward facing tab so that the upward tab can fit into the recessed area and under the tray surface, and that at least a portion of the valley of the downward tab is aligned underneath the horizontal tray surface. Alternatively stated, at least a portion of the downward tab is recessed under the tray surface. In one embodiment, a portion of the lip of the downward tab is directly beneath the vertical tray edge with the valley underneath the horizontal tray surface. In another embodiment only the upward facing tab is recessed into the tray edge. In yet another embodiment, both tabs are recessed into the tray edge or underneath the horizontal surface.

The modular flooring assembly is designed such that even if one or more tabs are broken on a given side, the tray substrates will still interlock. This also allows the modular flooring assemblies to be cut to a specific size and to still interlock.

The interlocking tabs may be positioned such that the modular flooring assemblies are offset supporting various decorative patterns.

The interlocking tabs on one modular flooring assembly need not be perfectly aligned with the other modular flooring assembly to allow "fine-tuning" of the relative tile position.

The bottom of the tray, i.e., opposite of the tray surface, is designed as the foundation of the system. The bottom may include structural webbing to strengthen the tray bottom ensuring the tray surface remains relatively flat.

The bottom of the tray may also include an optional non-skid and noise deadening padding of an over-molded, rubber-like material, such as thermoplastic rubber or thermoplastic elastomer. A particularly preferred thermoplastic elastomer is SANTOPRENE®. The padding provides a cushion for the flooring system. The padding also provides a non-skid element that prevents the flooring system from sliding on the underlying flooring material. The padding also provides some level of flex in the presence of underlying floor surface imperfections or heavy surface loads. The padding also helps reduce vibration transmission, thus providing a sound-deadening function. This padding may be adhered to the tray or overmolded.

As described above, various type of grout may be used in the present invention, including the snap-in grout or a fill-in grout compound that is spread into the gaps between neighboring trays.

Fill-in grouts may also be used with the trays. Fill-in grouts may be packaged in a powdered or granular form. The user mixes the powder or granules with a liquid to form a plastic material that is spread in between the modular flooring assemblies. Other fill-in grout compounds are packaged in a ready to spread form. The modular flooring assemblies are snapped together and the fill-in grout material is used to fill the space between the modular flooring assembly. The fill-in grout material must remain semi-flexible once cured since the floor "floats." The separate grout material must also have good adhesive qualities to ensure the material adheres to the sides of the modular flooring assemblies. Acrylic, urethane, epoxy, and latex modified grouts are suitable.

The flooring component may comprise tile, stone, marble, wood, or other conventional flooring materials. The flooring component could be a ceramic or porcelain tile, a natural stone product like marble or granite, or could be a wooden product.

The flooring component is adhered to the tray surface and tray edges using a variety of commercially available adhesives. Suitable adhesives for use with the present invention include a two-part epoxy using a methacrylate material, silicone, rubber based and urethane based. Other urethane adhesives may also be utilized. The specific selection of the adhesive will depend on the nature and properties of the flooring component. The methacrylate adhesive is preferred for ceramic tile. The tray edges define a space to receive the flooring component.

The present invention, by using a snap-in grout that is not permanently integrated with the tray, achieves advantages. The consumer may choose from among many different snap-in grout colors. Damaged snap-in grout can be easily replaced. Snap-in grout may also be changed to reflect different decorating tastes. Finally, flexibility is provided to either use snap-in grout or a fill-in grout.

The tray may be made using injection molding of a suitable plastic resin. High impact polystyrene is preferred, but other plastic resins including polypropolene and ABS—acrylobutadiene styrene may be used.

The padding of the non-skid and noise deadening material may be a thermoplastic rubber, thermoplastic elastomer, or other softer plastic material including SANTOPRENE®. The padding is over-molded or otherwise attached to the base of the tray. An adhesive is applied between the tray surface and the bottom of the flooring surface.

Multiple adhesive materials and application patterns can be used depending upon the combination of plastic resin used for the tray, the flooring material, and the profile of the flooring material. For tile application, adhesive is applied to the ridgelines on the bottom of the tile to maximize contact with the tray surface. Robotics may be used to improve the precision and efficiency of the assembly process. Robotics may also be used to package and palletize the finished products.

The modular flooring assemblies of the present invention may be used in almost any sized embodiment, including 152.4 mm (6-inch), 165.1 mm (6½-inch), 304.8 mm (12-inch), and 330.2 mm (13-inch) embodiments. The modular flooring assemblies have a square or rectangular shape. The square shaped modular flooring assemblies have four sides of equal length. Other sizes may be used, however these sizes are generally used in the flooring industry. Further, a combination of the 152.4 mm (6-inch) and 304.8 mm (12-inch) modular flooring assemblies may be used in combination to provide a unique appearance. The present invention may be further modified to include other combinations of different sized modular flooring assemblies.

During use of the present invention, the modular flooring assemblies are snapped together to form an overall flooring surface. The fill-in grout material may be applied between the modular flooring assemblies, or the snap-in grout may be installed. In order to accommodate different rooms of varying sized and shapes, the modular flooring assemblies can be cut using a wet saw if tile or stone is the flooring component or using a table or a circular saw for wooden flooring components.

The underlying flooring surface should be free of major surface variations, but need not be in perfect condition. No special floor preparation is required to ensure the tiles are fixed since the interlocking modular flooring assemblies will "float" and flex. The system can be installed directly on top of finished wood, linoleum, other tile, concrete, plywood, or a variety of other flooring systems. The modular flooring assemblies can be installed on top of padding or other underlayment material if an additional measure of insulation or padding is desired. The modular flooring assemblies can be installed on top of radiant-type heating systems as well.

The present invention will now be described with reference to the Figures where like numbers refer to like components in other figures. Each time a component is mention, its number is used so if it is not present in a given figure it can be found in another figure:

FIG. 1 shows tray substrate 100 having a tray surface 110 with vertical tray edges 160. The tray surface 110 receives the flooring component shown in FIG. 2 600, which in this embodiment is a ceramic tile.

Figure 2:
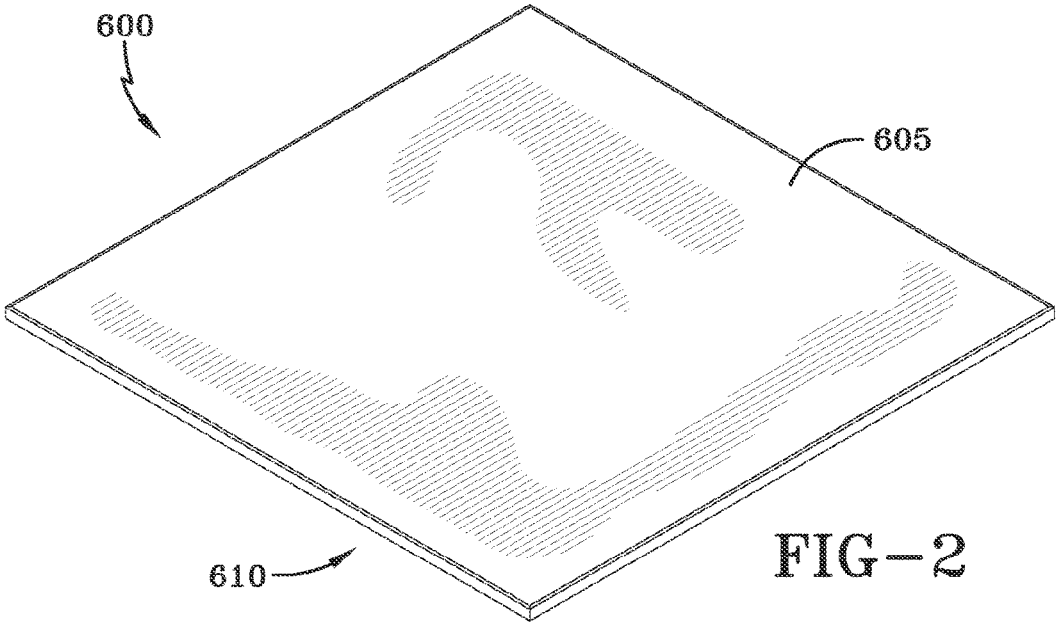
FIG. 2 is a perspective view of a flooring component.

FIG. 2 shows the flooring component 600. A top surface 605 of the flooring component 600 forms the floor surface. A bottom surface 610 of the flooring component 600 is adhered to the tray surface 110 by an adhesive. Although in this embodiment the flooring component 600 is a ceramic tile, the flooring component may be made from any flooring material.

Raised vertical tray edges 160 of the tray surface 110 help secure the flooring component 600 and prevent adhesive from leaking from the tray surface 110. The raised vertical tray edges 160 are preferably shorter than the height of the flooring component 600. Preferably the raised vertical edges 160 completely surround the flooring component 600.

Figure 3:
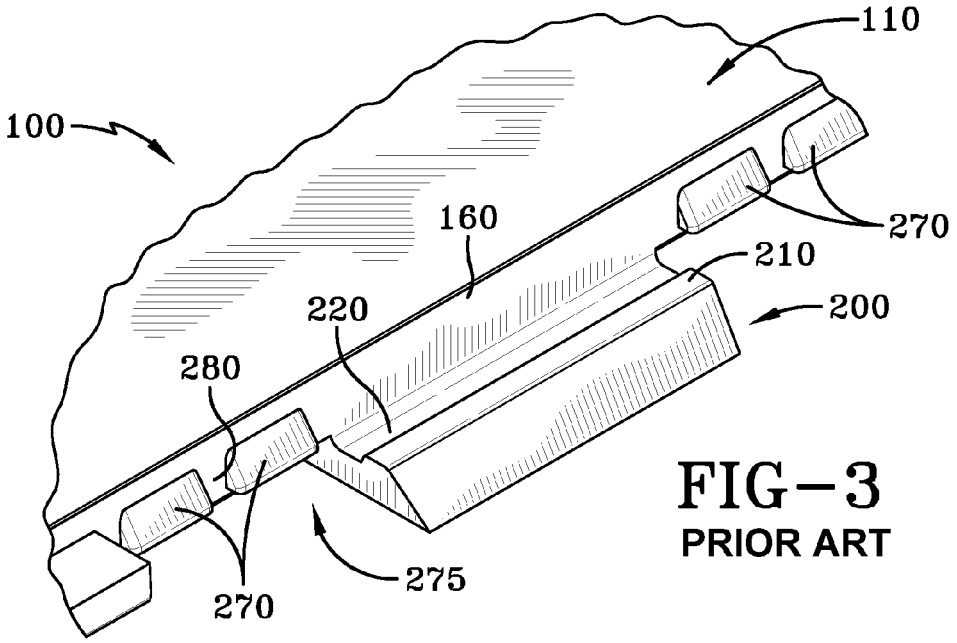
FIG-3 PRIOR ART
FIG. 3 is a perspective view of the prior art interconnect upward facing tab.
Figure 4:
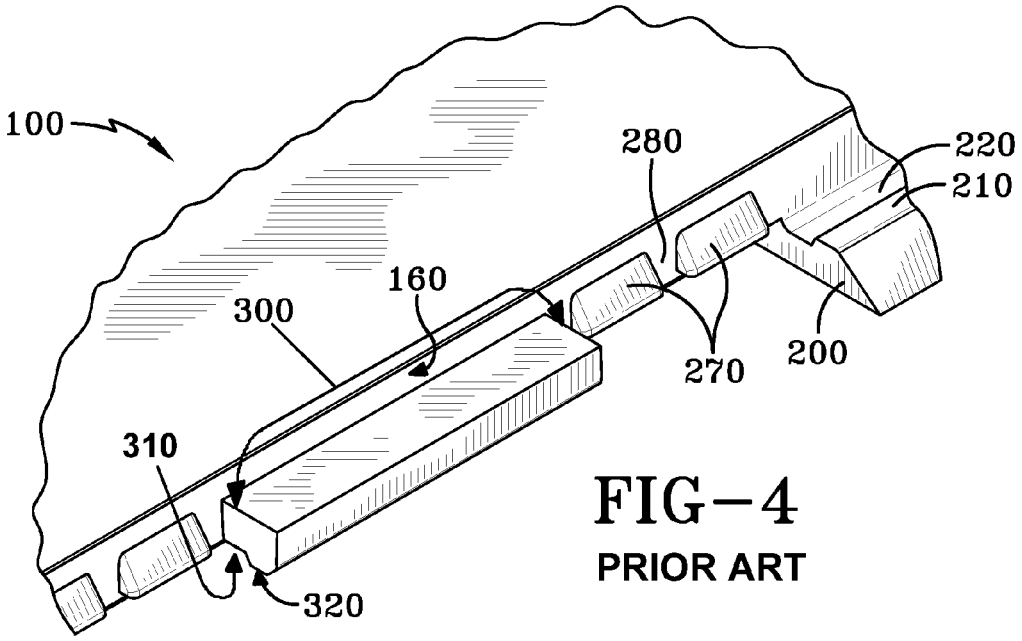
FIG-4 PRIOR ART
FIG. 4 is a perspective view of the prior art interconnect upward and downward facing tabs.
Figure 5:
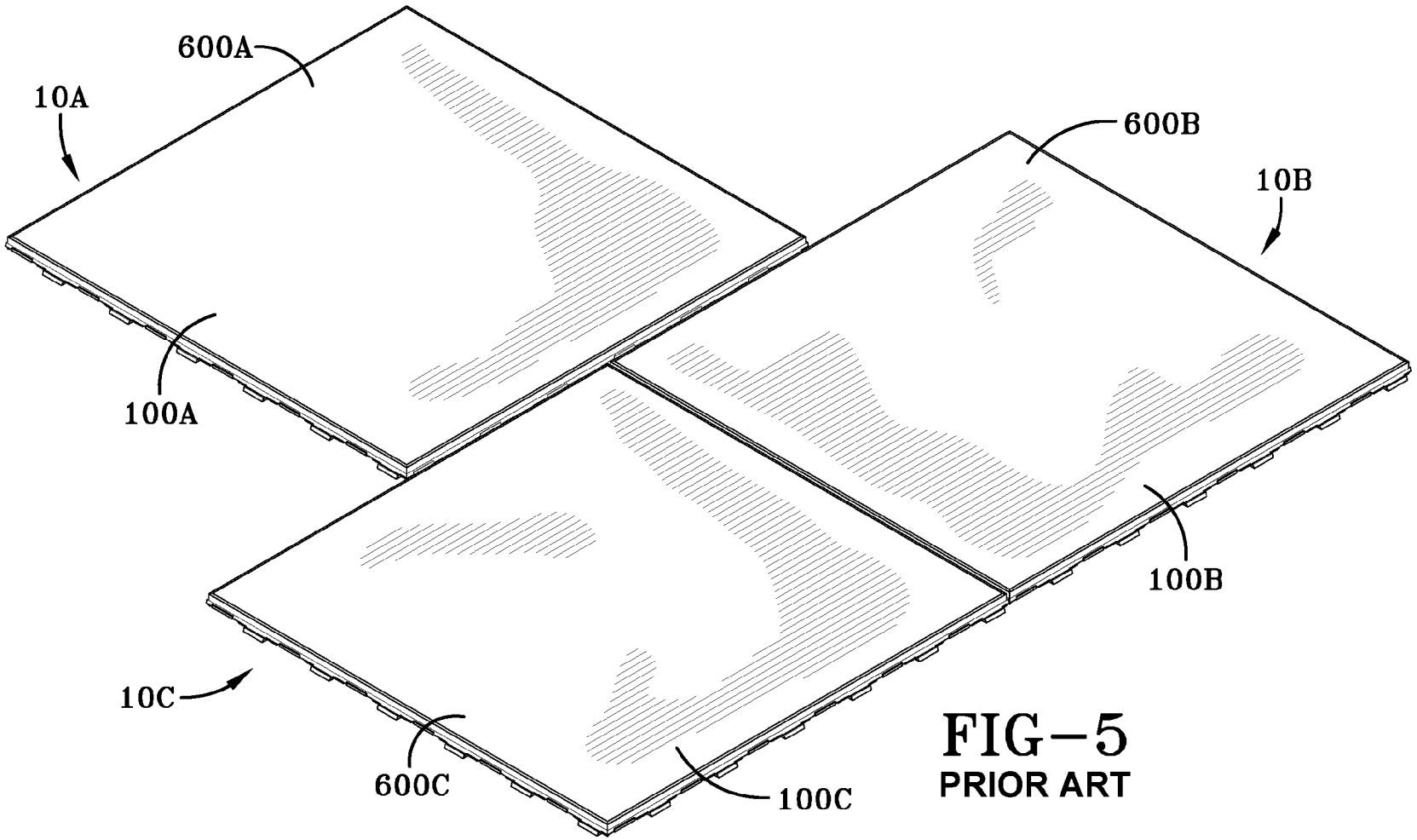
FIG–5 PRIOR ART
FIG. 5 shows three prior art modular flooring assemblies assembled.

FIGS. 3-5 show the interconnecting members of the prior art. A perimeter of the tray 100 is provided with a plurality of upward tabs 200 and a plurality of downward tabs 300. The upward tabs 200 interact with downward tabs 300 of an adjacent modular flooring assemblies, and the downward tabs 300 interact with the upward tabs (200) of the adjacent modular flooring assemblies. This provides the interconnection between adjacent modular flooring assemblies 10A, 10B, and 10C of FIG. 5.

In this embodiment of the prior art, the tray substrate 100 is provided with a total of six upward tabs 200 and downward tabs 300 per side of the tray 100. The tray 100 is designed to form a 304.8 mm (12-inch) flooring assembly, and more or less tabs may be utilized in larger modular flooring assemblies and smaller modular flooring assemblies.

Figure 4A:
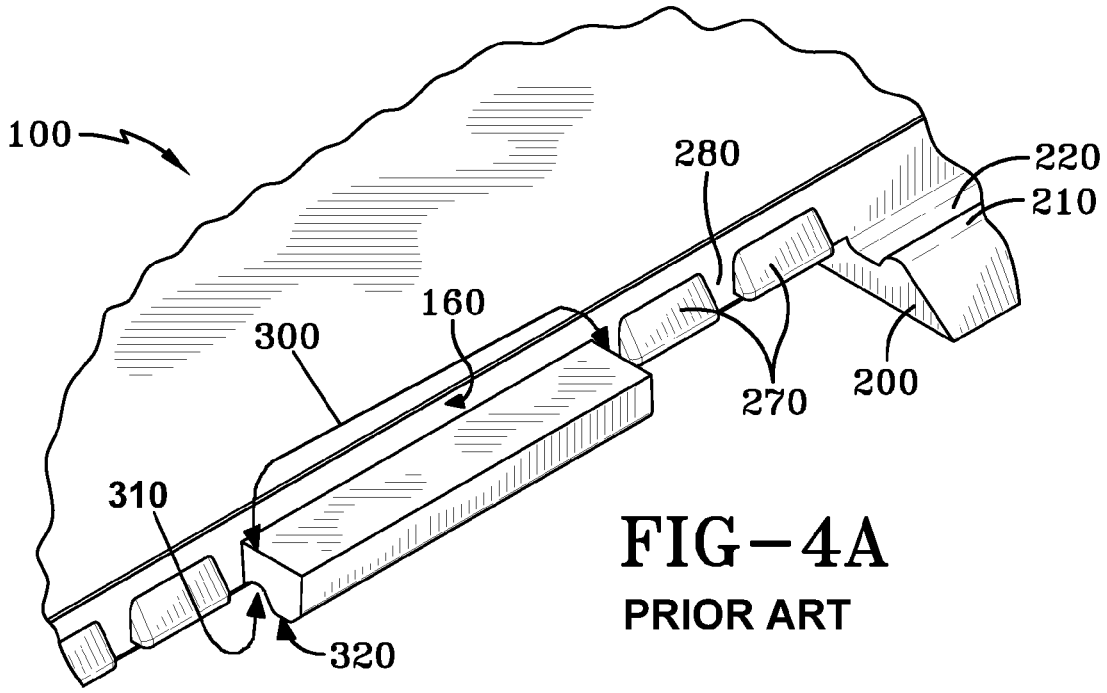
FIG-4A PRIOR ART

As shown in FIG. 3, the upward tab 200 includes a convex surface 210 and a valley 220. As shown in FIG. 4, the downward tab 300 includes a concave surface 310 and a lip 320. As the downward tab 300 is urged against the upward tab 200, the downward tab 300 flexes as the lip 320 slides over the convex surface 210 and into the valley 220, such that the lip 320 snaps into the valley 220 and the concave surface 310 presses over the convex surface 210. This provides a connection with sufficient rigidity to create a composite floor made of multiple modular flooring assemblies. There are grout holders 270 and are on all sides of the tray substrate angling downward and away from the edge of the tray in the downward direction. There is a space 280 between the grout holders with the bottom of the grout holder 275. FIG. 4A is similar to FIG. 4, except that the concavity and convex nature of 210 and 310 are more pronounced.

Although FIG. 3 shows the grout holders, the grout holders are optional and there are embodiments which would not have any grout holders, or may only have one grout holder.

Moreover, the interlocking connection between the downward tab 300 and the upward tab 200 may be separated such that the composite floor may be disassembled. This allows the user to change flooring as desired. Generally, the application of the modular flooring assemblies will not harm the sub floor.

FIG. 5 shows three of the prior art tray assemblies interlocked. 10A, 10B, and 10C are the interlocked tray assemblies. 600A, 600B, and 600C are the respective flooring components and 100A, 100B, and 100C are the respective tray substrates.

FIGS. 6-9 show the embodiment of the interlocks which permit the narrow gap between the interlocked tiles. Using the same numbering conventions as the prior art, the tray substrate 100 is provided with upward tabs 200 and downward tabs 300.

Figure 6:
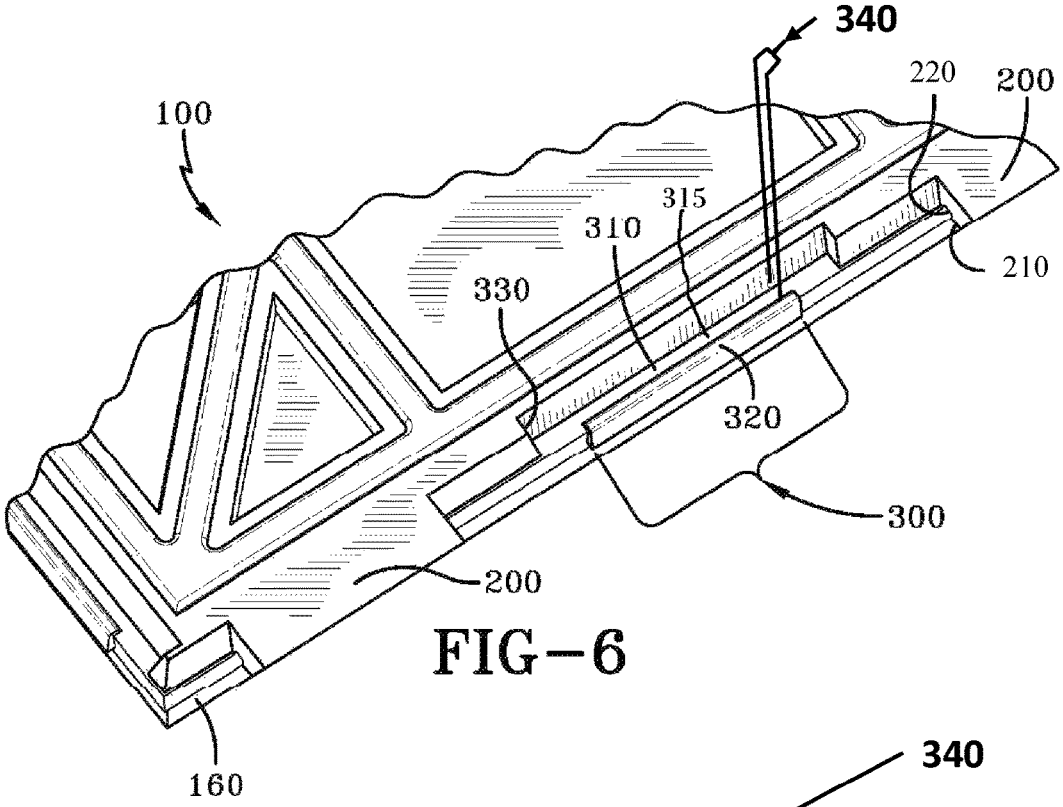
FIG. 6 is a perspective view of the recessed interconnect.
Figure 7:
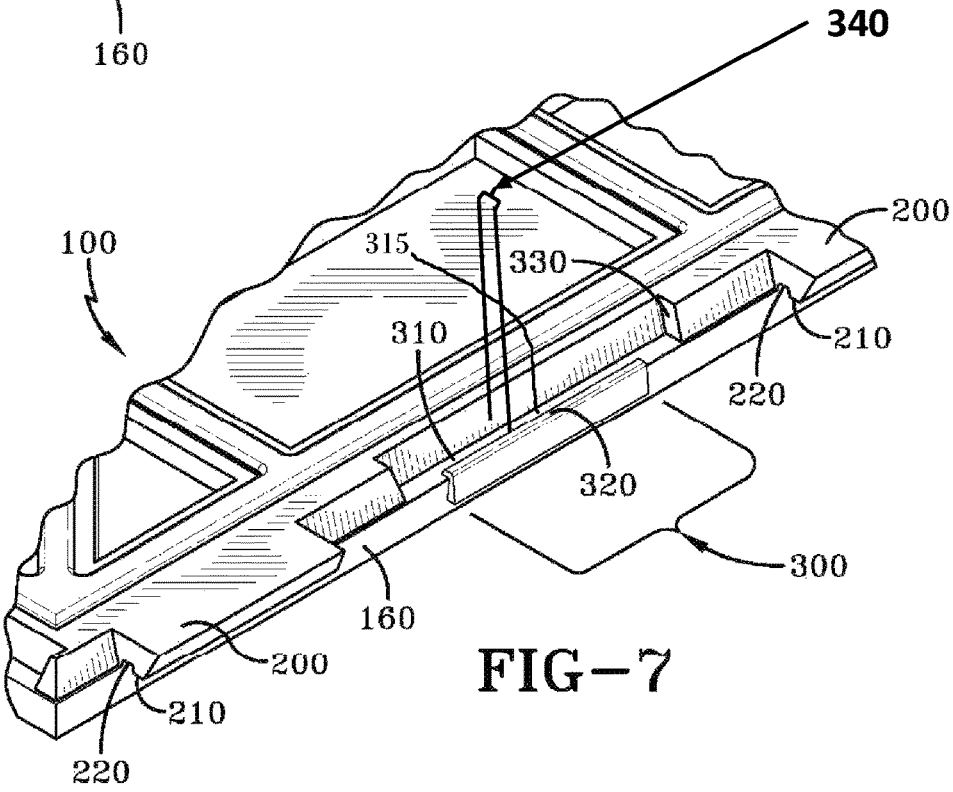
FIG. 7 is a side view of the recessed interconnect of FIG. 6.
Figure 8:
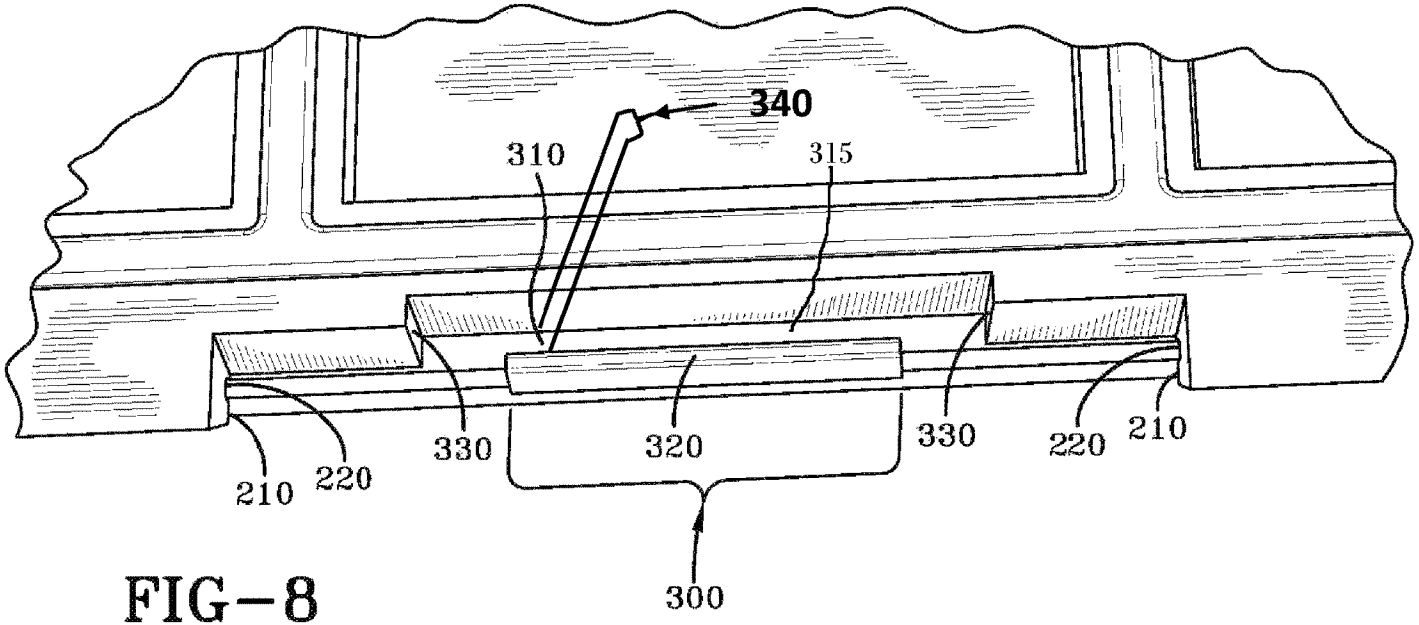
FIG. 8 is a bottom view of the recessed interconnect of FIG. 6.
Figure 9:
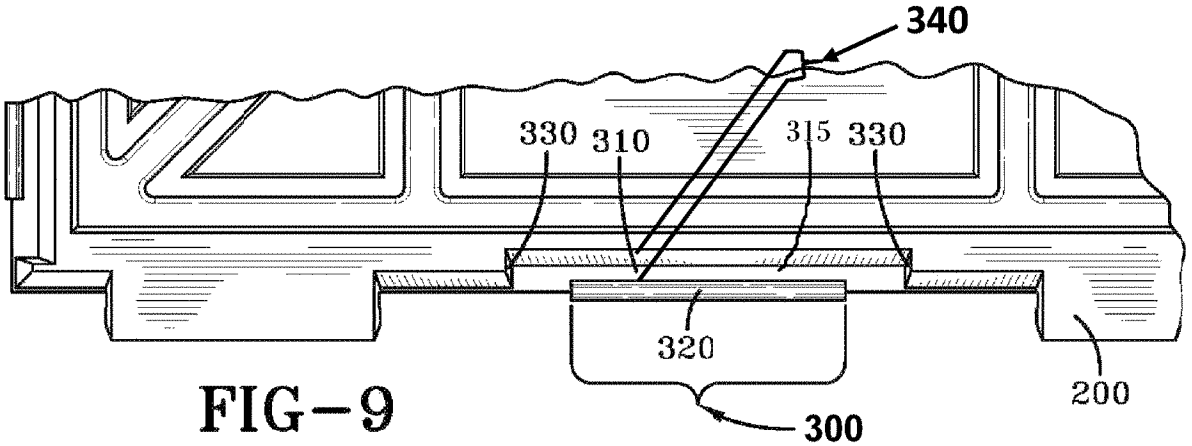
FIG. 9 is a bottom view of the recessed interconnect of FIG. 6.

As shown in FIG. 6, which is a view from the bottom of the tray substrate, the upward tab 200 includes a convex surface 210 and a valley 220. The downward tab 300 includes a concave surface 310 and a lip 320. As the downward tab 300 is urged against the upward tab 200, the downward tab 300 flexes as the lip 320 slides over the convex surface 210 and into the valley 220, such that the lip 320 snaps into the valley 220 and the concave surface 310 presses over the convex surface 210.

The thin grout line is achieved by the fact that the channel 340 comprising surface 310 is recessed into the wall of the tray substrate 330 and underneath the tray surface. Depending upon the width of grout line desired, 310, at least a portion of the lip, 320, could lie directly under the vertical tray edge 160. At least a portion of at least some of the downward tabs of the plurality of downward tabs is underneath the tray surface.

Figure 10:
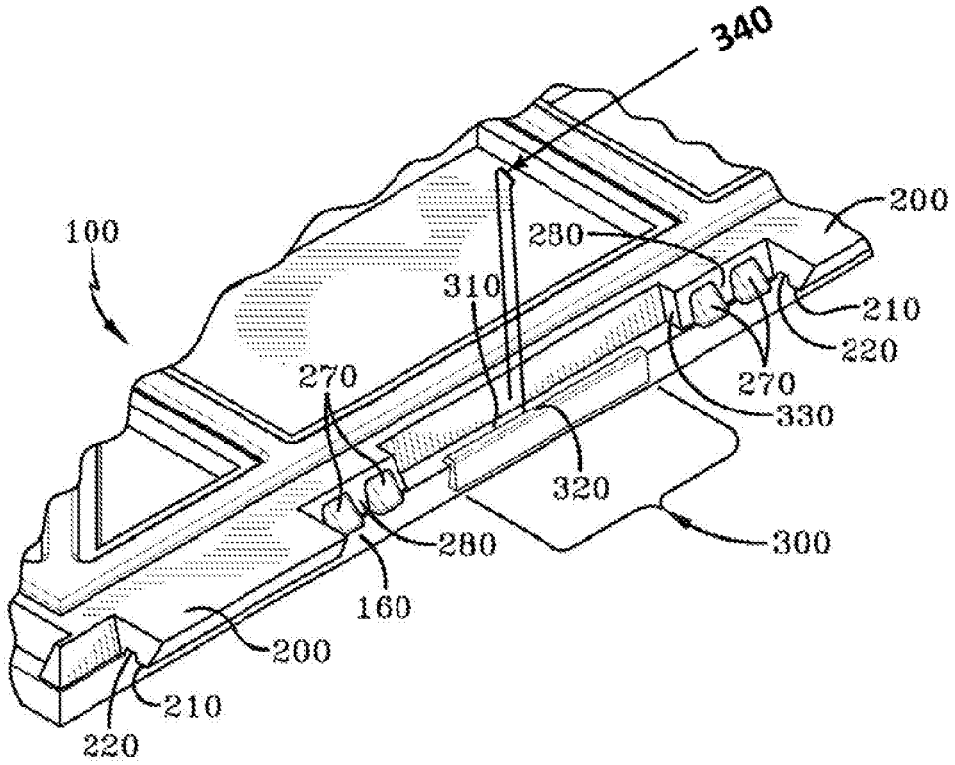
FIG. 10 is a bottom view of one embodiment of the current invention showing the recessed interconnect with grout holders on the perimeter.

As in the prior art, there may also be grout members protruding from the edge of the tray substrate. This is shown in FIG. 10 with grout holders 270 and the gap between them 280.

Figure 11A:
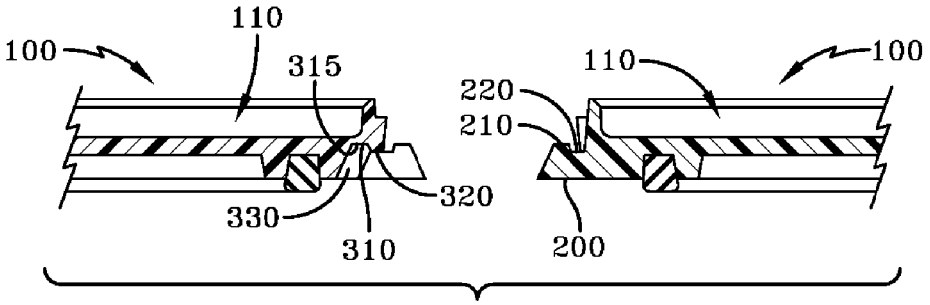
FIG. 11A is a cross section of one embodiment of the current invention showing two tray substrates aligned to interlock.
Figure 11B:
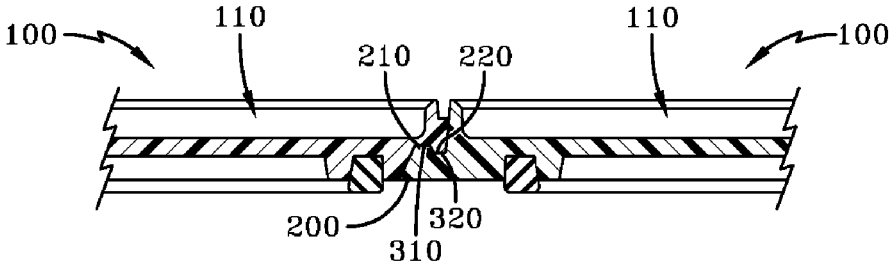
FIG. 11B is a cross section of the two substrates of FIG. 11A that have been assembled and interlocked.

FIGS. 11A and 11B show two trays assembled and the narrow thin grout line. FIG. 11A shows two disassembled tray substrates 100 each having a horizontal surface 110. As can be seen in the tray substrate on the left, the surface 310 of the downward facing tab is recessed underneath the horizontal surface of the tray substrate. FIG. 11B shows the two tray substrates interlocked. As can be seen the upward facing tab 200 interlocks with the downward facing tab and the surface 210 of the upward facing tab is mated to the surface 310 of the downward facing tab. Because the downward facing tab is at least partially underneath the horizontal tray surface, the interlock produces a narrower grout line than the prior art.

Figure 12:
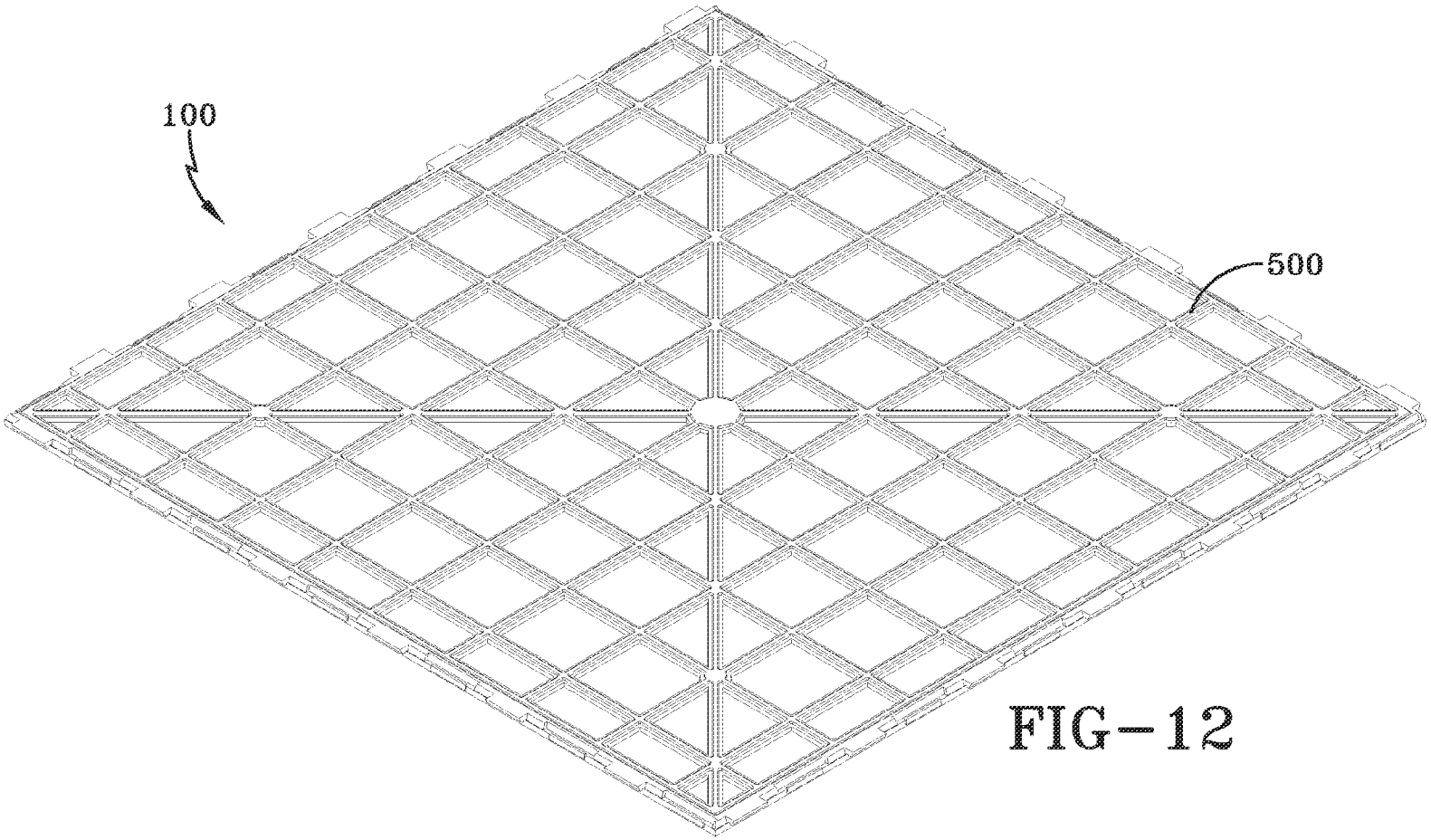
FIG. 12 is the back of the tray showing the pad.

An optional padding 500 is shown in FIG. 12. The padding 500 may be over-molded to the tray bottom.

As is evident from the foregoing description, certain aspects of the present invention are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present invention.

Figure 13:
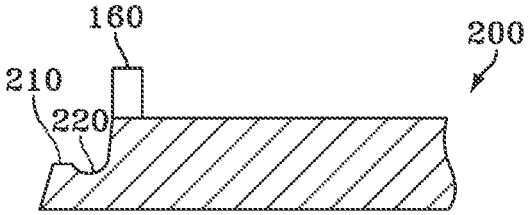
FIG. 13 is a cross section of the tray showing the downward tab.
Figure 14:
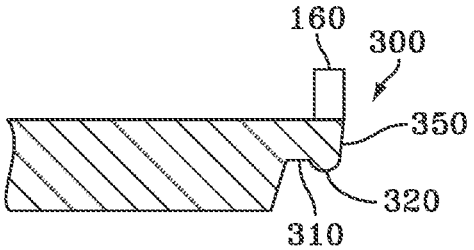
FIG. 14 is a cross section of the tray showing the upward tab.
Figure 15:
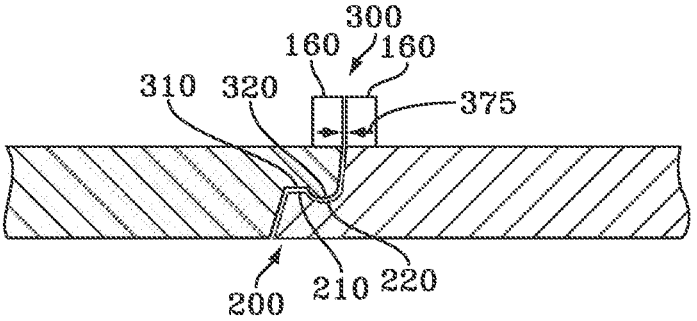
FIG. 15 is a cross section of two tray substrates joined at an upward and downward tab.
Figure 16:
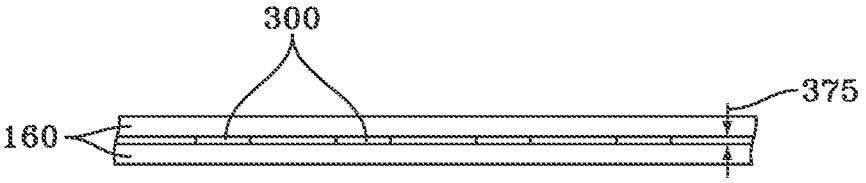
FIG. 16 is a top view of two tray substrates joined together.

As shown in FIG. 13, the upward tab 200 includes a convex surface 210 and a valley 220. As shown in FIG. 14, the downward tab 300 includes a concave surface 310 and a lip 320. As further shown in FIG. 15, at 350 a portion of the downward tab protrudes away from the vertical tray edge 160 to create a portion of the grout line. As shown in FIG. 15 and FIG. 16, the downward tab 300 and the upward tab 200 are joined such that the lip 320 snaps into the valley 220 and the concave surface 310 presses over the convex surface 210. When the downward tab and the upward tab are joined the space between the vertical tray edges 160 forms the grout gap for the grout indicated by the arrow marked 375. For convenience, FIG. 13, FIG. 14 and FIG. 15 show only the cross sectional view of the downward tab and/or the upward tab. Objects residing behind the downward tab and/or the upward tab are omitted.

I claim:

1. A component of a flooring system comprising a tray substrate having:

a tray substrate surface which is an upward facing horizontal surface having a tray substrate surface perimeter, the tray substrate surface further comprising a pattern design which complements a mold pattern on a bottom surface of a flooring component, a tray substrate bottom, a plurality of vertical tray edges which protrude upward and extend along the tray substrate surface perimeter, a plurality of tray substrate edges defining an outside perimeter of the tray substrate, the tray substrate edges having a plurality of upward tabs comprising a convex surface and a valley;

the tray substrate edges further comprising a plurality of downward tabs comprising a concave surface and a lip, wherein at least a portion of the downward tabs is recessed under the upward facing horizontal tray surface, and wherein at least a portion of the lip of the downward tabs is directly beneath the tray substrate surface perimeter wherein the flooring component is smaller than the tray substrate surface.

2. The component of claim 1, wherein the component further comprises an adhesive wherein the flooring component is adhered to the tray substrate surface with the adhesive.

3. The component of claim 2, wherein the component further comprises a padding attached to the tray substrate bottom.

4. The component of claim 3, wherein the flooring component is selected from the group consisting of tile, stone, marble, wood, ceramic tile, porcelain tile, and granite.

5. The component of claim 2, wherein the flooring component is selected from the group consisting of tile, stone, marble, wood, ceramic tile, porcelain tile, and granite.

6. The component of claim 1, wherein the component further comprises a padding attached to the tray substrate bottom.

7. The component of claim 6, wherein the flooring component is selected from the group consisting of tile, stone, marble, wood, ceramic tile, porcelain tile, and granite.

8. The component of claim 1, wherein the flooring component is selected from the group consisting of tile, stone, marble, wood, ceramic tile, porcelain tile, and granite.

* * * * *